US006134865A

United States Patent [19]

Long

[11] Patent Number: 6,134,865

[45] Date of Patent: Oct. 24, 2000

[54] PAPER STACK HANDLER

[75] Inventor: John Albert Long, Scarborough, Canada

[73] Assignee: Longford Equipment International Limited, Scarborough, Canada

[21] Appl. No.: 09/028,084

[22] Filed: Feb. 23, 1998

[51] Int. Cl.[7] ..... B65B 35/30; B65B 35/46

[52] U.S. Cl. ..... 53/540; 53/569; 53/531

[58] Field of Search ..... 53/252, 258, 384.3, 53/540, 569, 566, 579, 531; 198/462.3, 732; 414/788, 907

[56] References Cited

U.S. PATENT DOCUMENTS

| | | | |
|---|---|---|---|
| 2,805,757 | 9/1957 | Rapley | 198/462.3 |
| 3,162,294 | 12/1964 | Dieter | 198/732 |
| 3,533,496 | 10/1970 | Atwood | 198/732 |
| 3,879,920 | 4/1975 | Langen | 53/252 |
| 4,101,020 | 7/1978 | Langen | 198/732 |
| 4,525,986 | 7/1985 | Noll | 53/252 |
| 4,682,684 | 7/1987 | Lothman | 198/732 |
| 4,899,518 | 2/1990 | Beeman | 53/252 |
| 4,955,185 | 9/1990 | Haas | 53/569 |
| 5,168,689 | 12/1992 | Macelis | 53/569 |
| 5,197,586 | 3/1993 | Sala | 198/462.3 |
| 5,430,990 | 7/1995 | Long | 53/252 |
| 5,457,941 | 10/1995 | Long et al. | 53/460 |
| 5,560,184 | 10/1996 | Tisma | 53/540 |

*Primary Examiner*—John Sipos
*Attorney, Agent, or Firm*—Rader, Fishman & Grauer PLLC

[57] ABSTRACT

An on-the-fly paper stack handler has a paper stack conveyor for continuously serially conveying stacks of paper, a tray conveyor disposed below and downstream of the paper stack conveyor for continuously serially conveying trays, and a transfer conveyor extending between the paper stack conveyor and the tray conveyor for conveying stacks of paper along a path from the paper stack conveyor into the trays. The transfer conveyor has a platform for supporting paper stacks and has pushers extending downwardly into the path of the paper stacks so that these pushers may push the stacks into the trays and operate in close proximity to the trays. A rest arm extending downstream from the transfer conveyor rests on the stacks in the trays to maintain control of same.

4 Claims, 11 Drawing Sheets

PAPER STACK HANDLER

BACKGROUND OF THE INVENTION

This invention relates to an on-the-fly paper stack handler which may be part of an envelope stuffing machine.

U.S. Pat. No. 5,457,941 issued Oct. 17, 1997 to Long et al. and U.S. Pat. No. 5,430,990 issued Jul. 11, 1995 to Long disclose on-the-fly envelope stuffing machines. These machines comprise a tray conveyor with trays for holding stacks of inserts. After a stack of inserts is placed on a tray, a pair of flippers may be pivoted about a pivot mount near the rear of the tray into a position over the stack. The tray is cammed toward an envelope conveyor as it moves downstream so that the end of the flippers enter the throat of an envelope. Next a reciprocating pusher on the tray is cammed forward, displacing the flippers outwardly toward the edges of the envelope to assist in opening the envelope while pushing the inserts into the envelope.

A difficulty with these machines is in supplying the stacks of inserts to the trays in a controlled fashion and in maintaining control of the inserts while the flippers move into place above the stacks.

SUMMARY OF THE INVENTION

According to the present invention, there is provided an on-the-fly paper stack handler, comprising: a paper stack conveyor for continuously serially conveying stacks of paper; a tray conveyor having an upstream end disposed below and downstream of a downstream end of said paper stack conveyor, said tray conveyor for continuously serially conveying a plurality of trays; a transfer conveyor extending between said paper stack conveyor downstream end and said tray conveyor upstream end for conveying stacks of paper along a path from said paper stack conveyor into said trays, said transfer conveyor comprising paper stack pushers extending downwardly into said path.

In one aspect, the transfer conveyor has a stationary abutment for slidingly abutting the paper stack pushers in order to maintain said paper stack pushers in an extended position extending into the path. This abutment ends upstream of the downstream end of the transfer conveyor.

In another aspect, the paper stack conveyor has flights for pushing stacks of paper and a stationary flight abutment for slidingly abutting the flights in order to maintain the flights in an extended operative position. The stationary flight abutment ends upstream of a downstream end of the insert conveyor so that a given flight ceases to push a stack after passing an end of the stationary flight abutment.

The present invention also provides an on-the-fly paper stack conveyor, comprising: a paper stack conveyor for continuously serially conveying stacks of paper; a tray conveyor having an upstream end disposed downstream of a downstream end of said paper stack conveyor, said tray conveyor for continuously serially conveying a plurality of trays; a transfer conveyor extending between said paper stack conveyor downstream end and said tray conveyor upstream end for conveying stacks of paper along a path from said paper stack conveyor into said trays, said transfer conveyor comprising paper stack pushers extending downwardly into said path; said paper stack conveyor comprising flights for pushing stacks of paper, and including one or more drives for moving said flights more quickly than said paper stack pushers so that a given stack of paper advances to a paper stack pusher of a next downstream stack of paper just as a flight ceases pushing said given stack of paper whereby said given stack of paper is registered.

BRIEF DESCRIPTION OF THE DRAWINGS

In the figures which disclose example embodiments of the invention.

DESCRIPTION OF THE PREFERRED EMBODIMENTS

Figure 1:
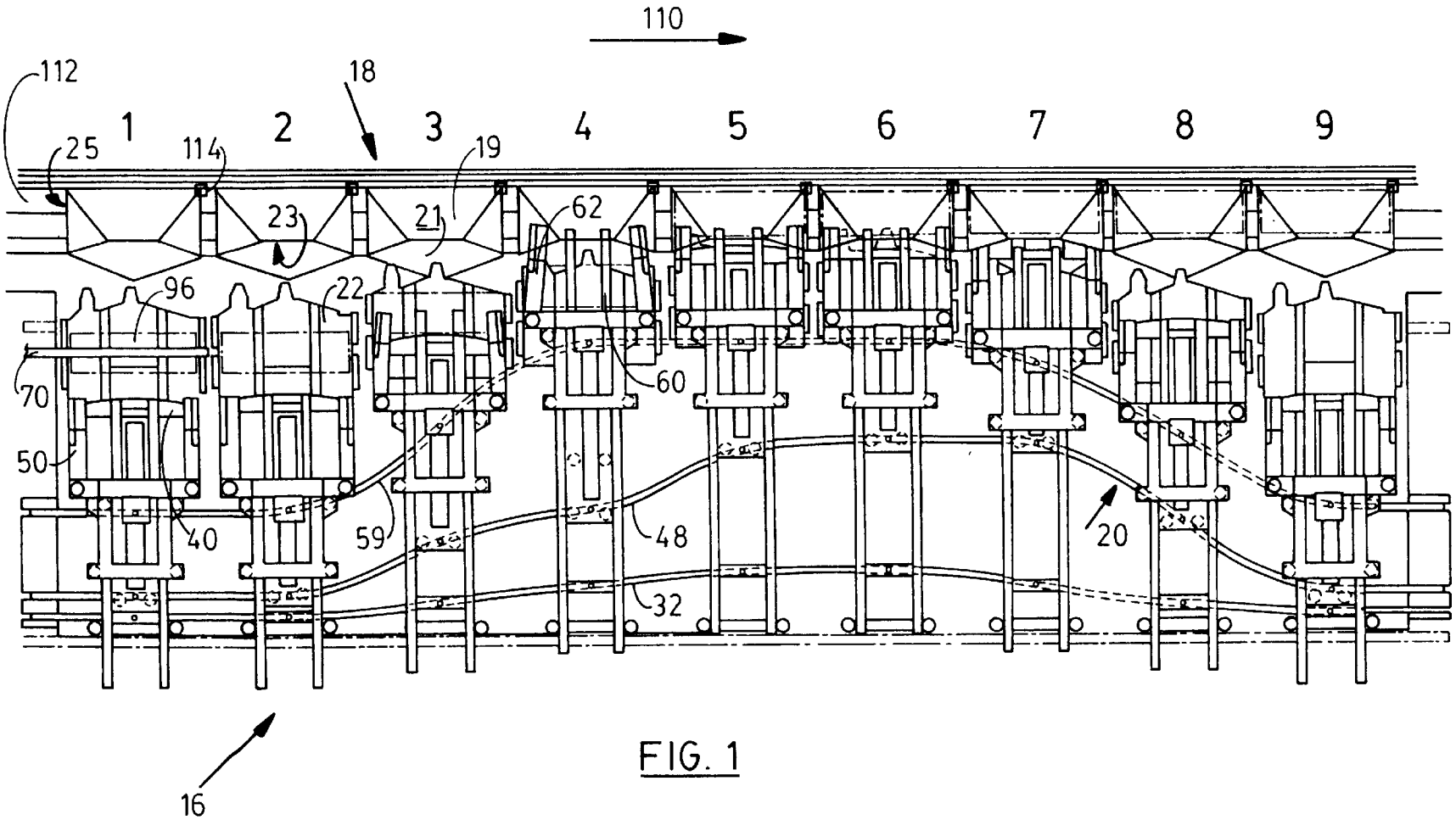
FIG. 1 is a plan view of a portion of an on-the-fly envelope stuffing machine made in accordance with this invention.
Figure 12:
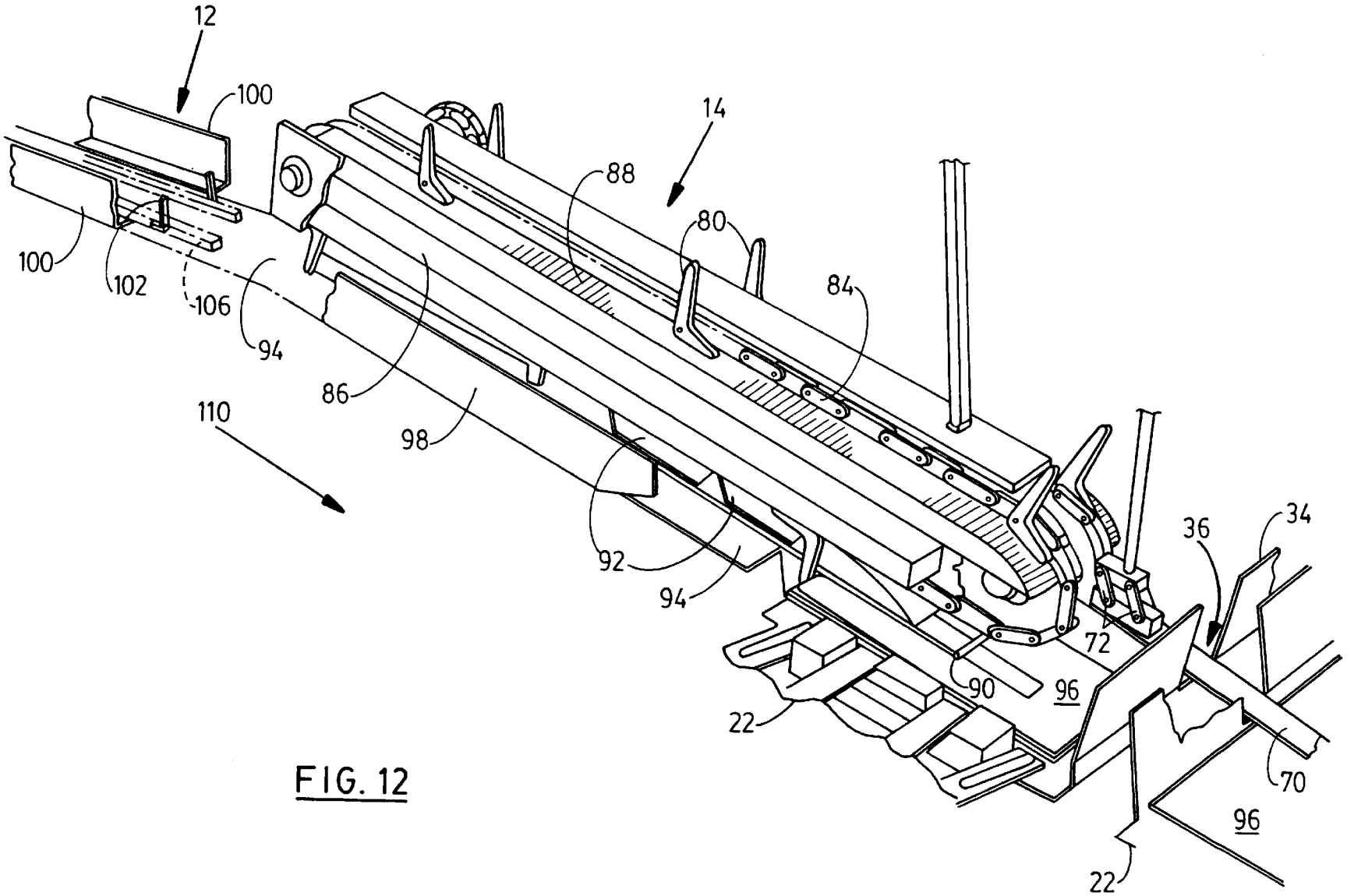
FIG. 12 is a perspective view of a portion of the envelope stuffing machine upstream of position 1 of FIG. 1.

With reference to FIGS. 1 and 12, a paper stack handler comprises, in downstream order, a paper stack conveyor 12, a transfer conveyor 14, and a tray conveyor 16. An envelope conveyor 18 for conveying envelopes 19 runs in parallel with the tray conveyor.

Figure 2:
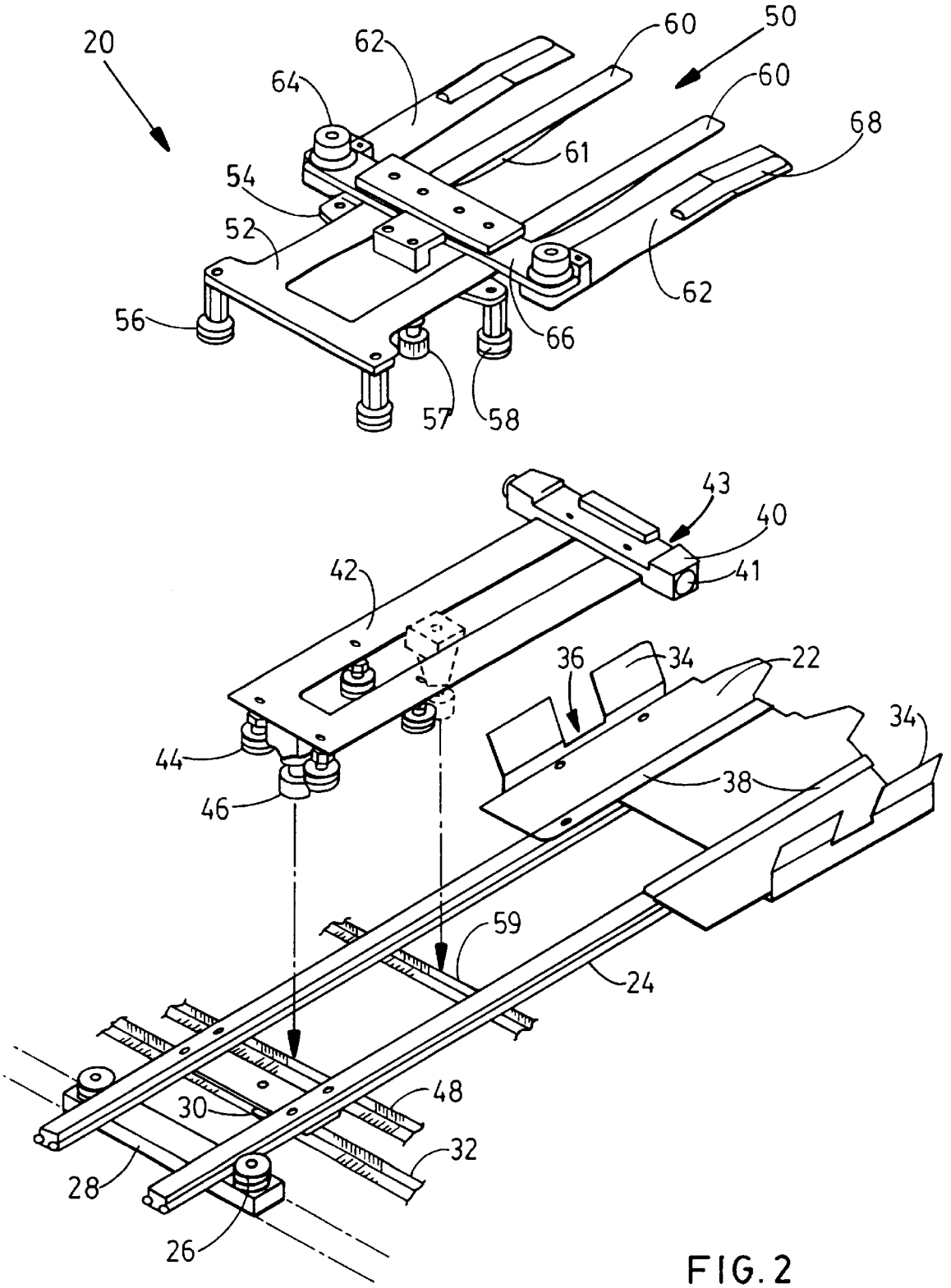
FIG. 2 is an exploded perspective view of a portion of FIG. 1, FIGS. 3 to 5 are plan views of portions of FIG. 2.
Figure 4:
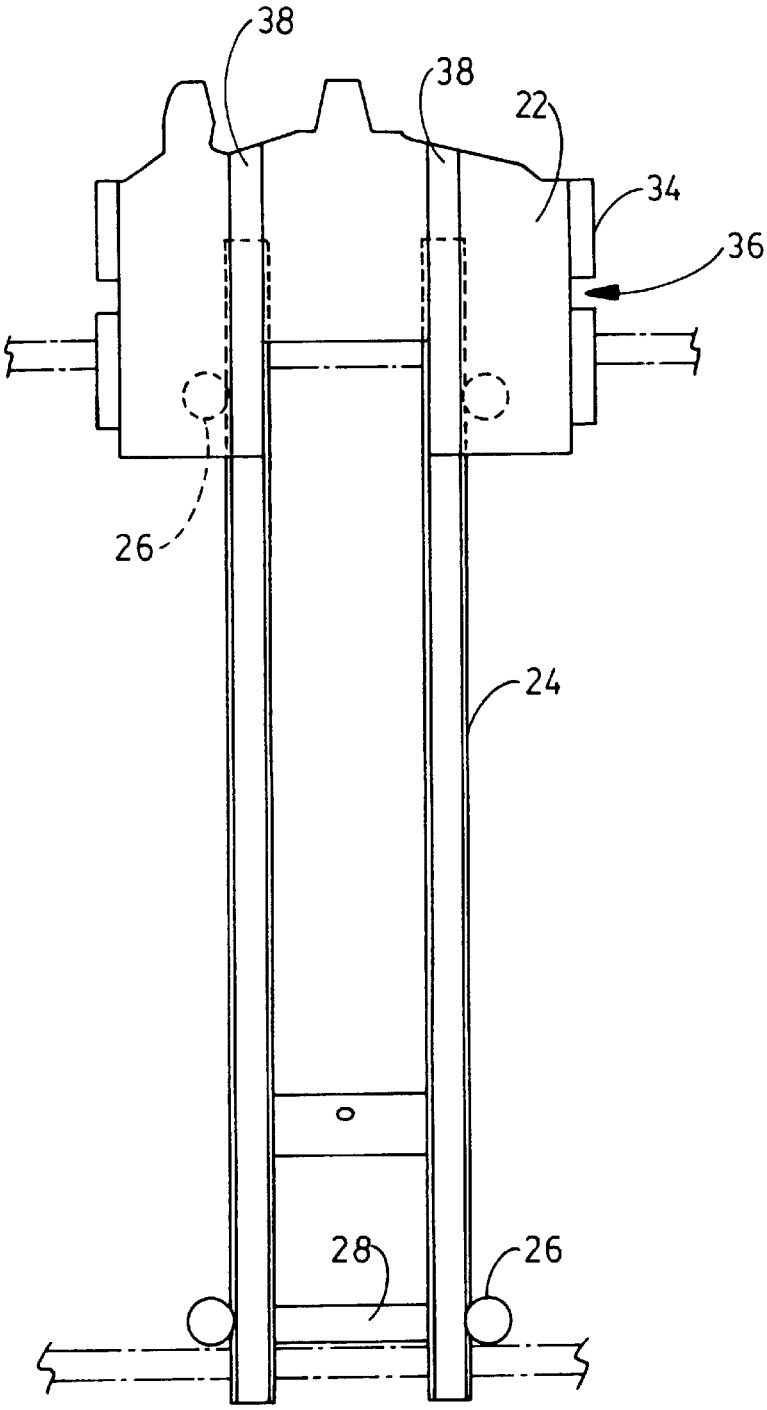
Figure 5:
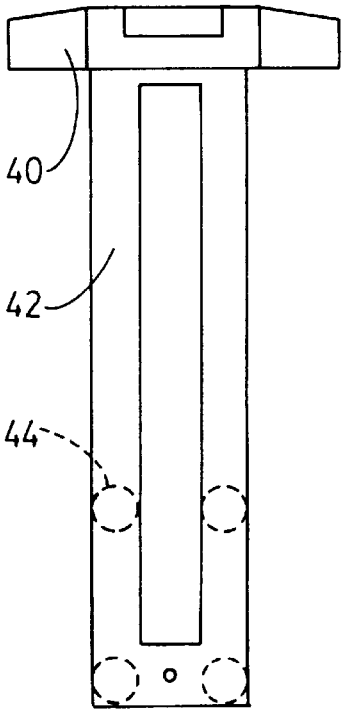

The tray conveyor comprises a series of tray assemblies 20. Turning to FIG. 2, each tray assembly 20 comprises a tray 22, a reciprocating pusher 40, and a finger assembly 50. Referencing FIGS. 2 and 4, tray 22 is affixed to rails 24. The rails are mounted on rollers 26 so as to permit reciprocating movement; the rollers are supported by chain driven blocks 28. A cam pin 30 extends downwardly from the rails into a tray cam track 32. The tray has inclined sidewalls 34, each with a medial slot 36; the tray also has a pair of raised runners 38. Referencing FIGS. 2 and 5, the pusher 40 extends from a frame 42 which is mounted by rollers 44 to rails 24 in order to permit reciprocating movement. A cam pin 46 extends downwardly from frame 42 into a cam track 48.

Figure 3:
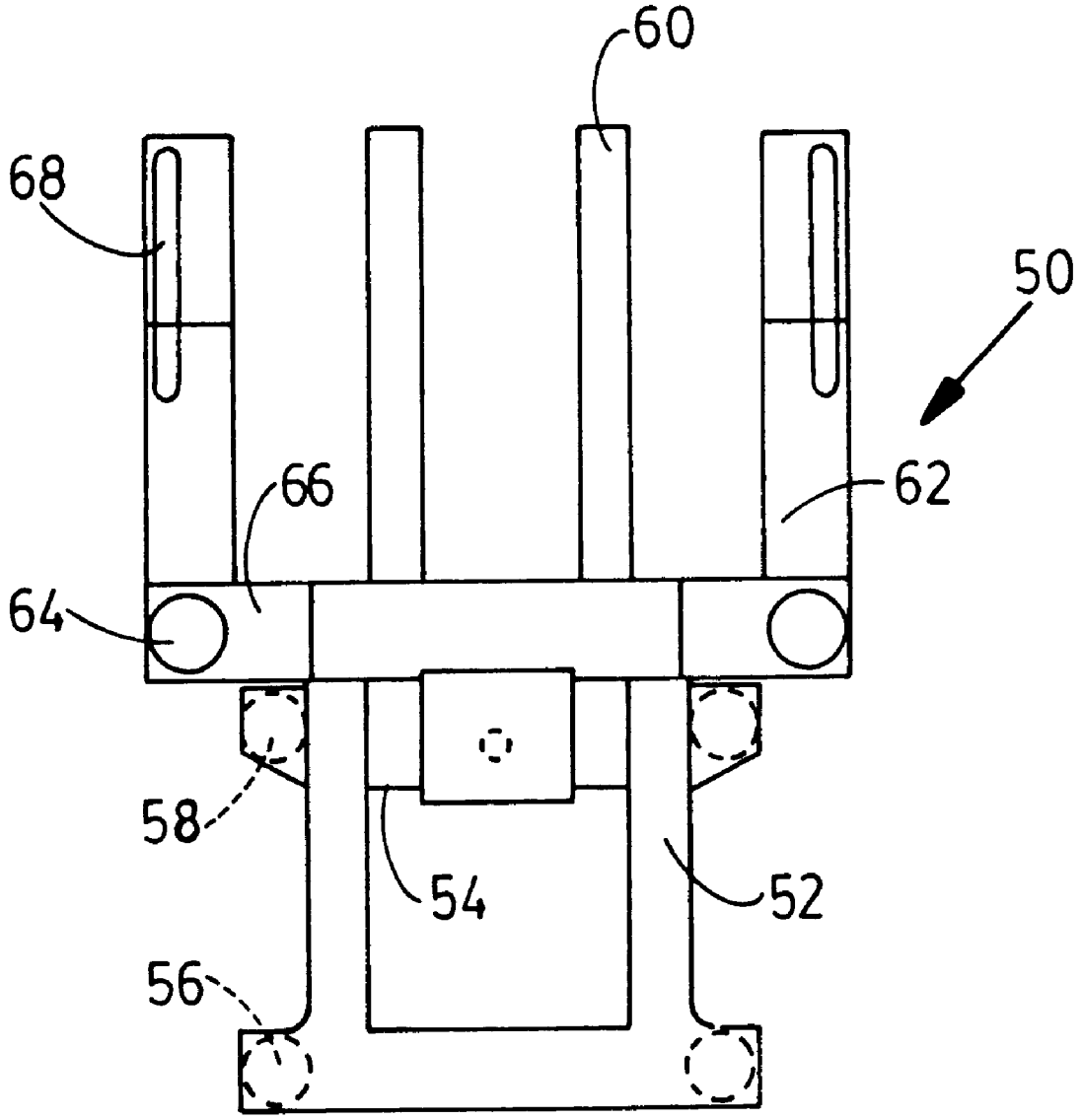
Figure 6:
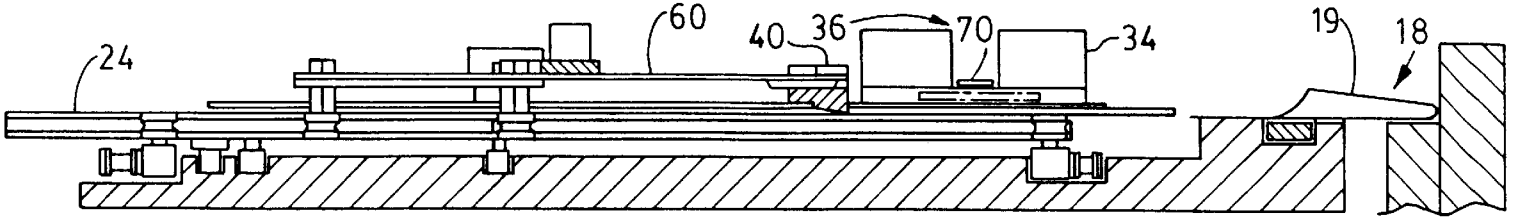
FIG. 6 is a cross-sectional view of a tray at position 1 of FIG. 1.
Figure 9:
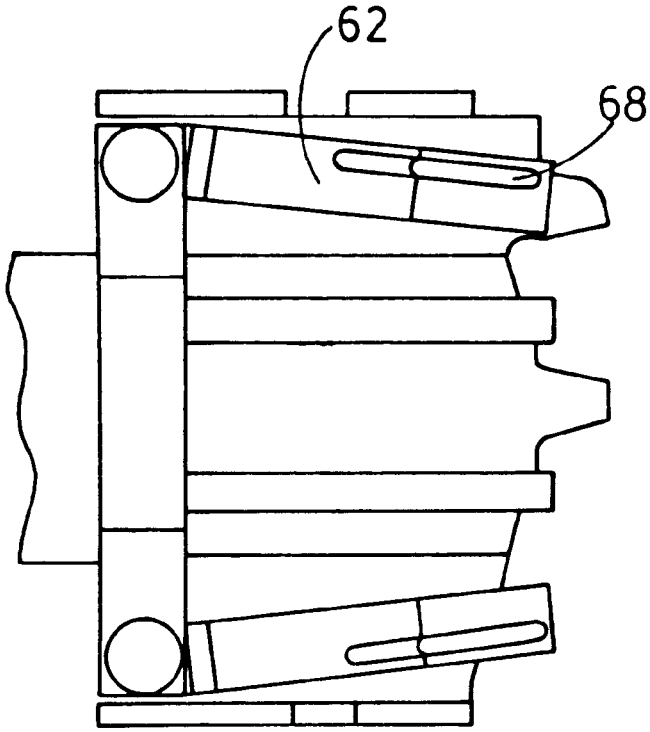
FIG. 9 is a plan view of a portion of a tray at position 4 of FIG. 1.
Figure 11:
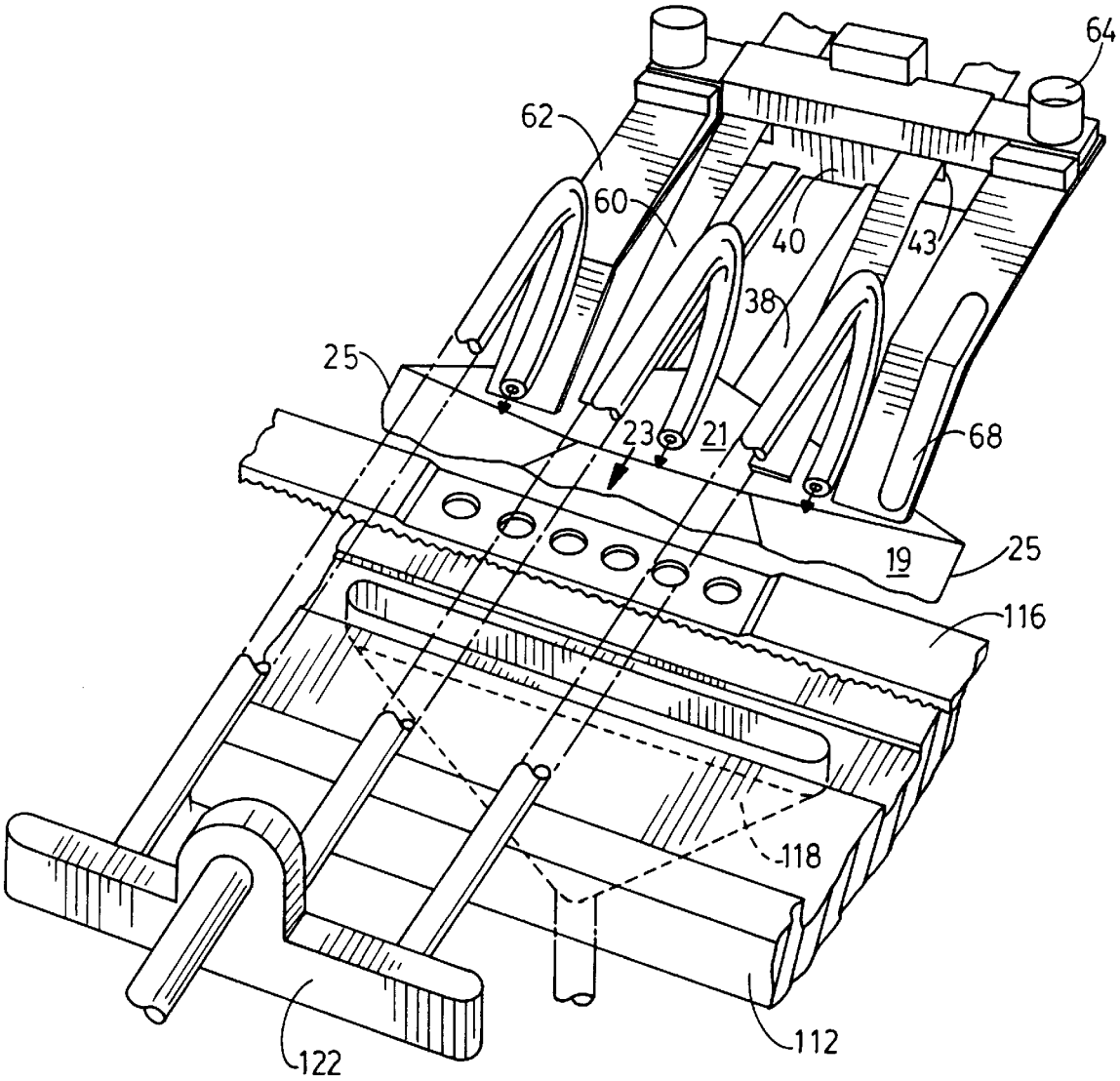
FIG. 11 is a perspective view of a portion of the envelope stuffing machine between positions 3 and 4 of FIG. 1.

Referring to FIG. 6, the pusher 40 has a rearwardly tapering wedge-shaped cross-section. As seen in FIG. 11, the pusher has downwardly opening notches which receive runners 38 of tray 22. Turning to FIG. 3 along with FIG. 2, the finger assembly 50 comprises frame members 52 and 54 which are mounted to rails 24 by rollers 56, 58, respectively, so as to permit reciprocating movement of frame members 52, 54. Frame member 52 extends over frame member 54 and terminates in a pair of spring fingers 60. The frame member 52 is mounted to rollers 56 at a slight downward angle such that the frame member 52 is biased against frame member 54. Each spring finger 60 has a downwardly extending ramping cam surface 61. Frame member 54 has a depending cam pin 57 which is received in a cam track 59. A pair of flipper fingers 62 is pivotably mounted by pivots 64 to bar 66 which is joined to frame 54. Each pivot 64 has a torsion spring such that the flippers are biased to a toed-in position (as seen in FIG. 9). Each flipper has an upper convexly rounded surface 68.

The pusher 40 has a button 41 on either end which abuts the inside edge of a flipper 62. The pusher also has upwardly opening notches 43 which, as seen in FIG. 11, receive spring fingers 60.

Returning to FIG. 1, a rest arm 70 extends from the upstream end of the tray conveyor 16. Turning to FIG. 12, the rest arm 70 is suspended by pivot links 72 which allow the rest arm a limited pivotable range of motion.

The downstream direction is indicated in FIG. 1 at 110. The envelope conveyor 18 comprises a base 112 for supporting envelopes with a series of chain driven gripper jaws 114 extending along the base and grip the leading edge of each envelope proximate its bottom edge. These gripper jaws are of the type described in the aforereferenced U.S. Pat. No. 5,430,990, the contents of which are incorporated by reference herein.

Figure 11A:
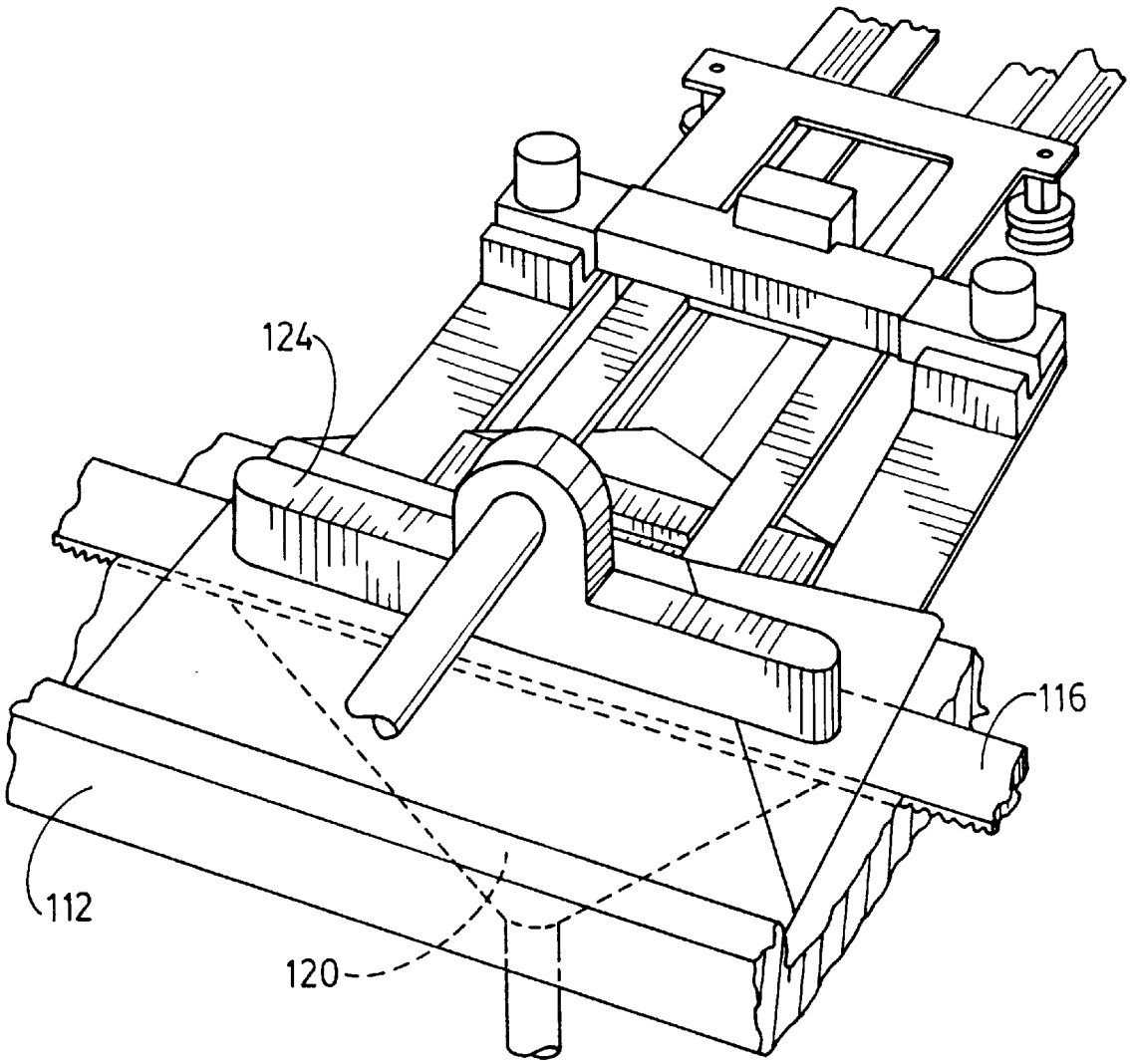
FIG. 11A is a perspective view of a portion of the envelope stuffing machine at position 5 of FIG. 1.

Turning to FIGS. 11 and 11A, the envelope conveyor 18 has, between stations 3 and 6 of FIG. 1, a vacuum belt 116 underlying the envelopes which is controlled to move at the same speed as the chain driven envelope grippers. Vacuum manifolds 118 and 120 extend through the base 112 of the envelope conveyor to communicate a vacuum to the belt 116 in order to draw the underside of the envelopes onto the belt. Vacuum manifold 118 is positioned below air puffer 122. Vacuum manifold 120 is positioned below a vacuum manifold 124 at a downstream location whereat camming ramps (not shown) act on cam wheels (not shown) of the envelope grippers to cam open the grippers. Suitable camming ramps and cam wheels for the grippers are shown in the aforenoted U.S. Pat. No. 5,430,990.

Figure 13:
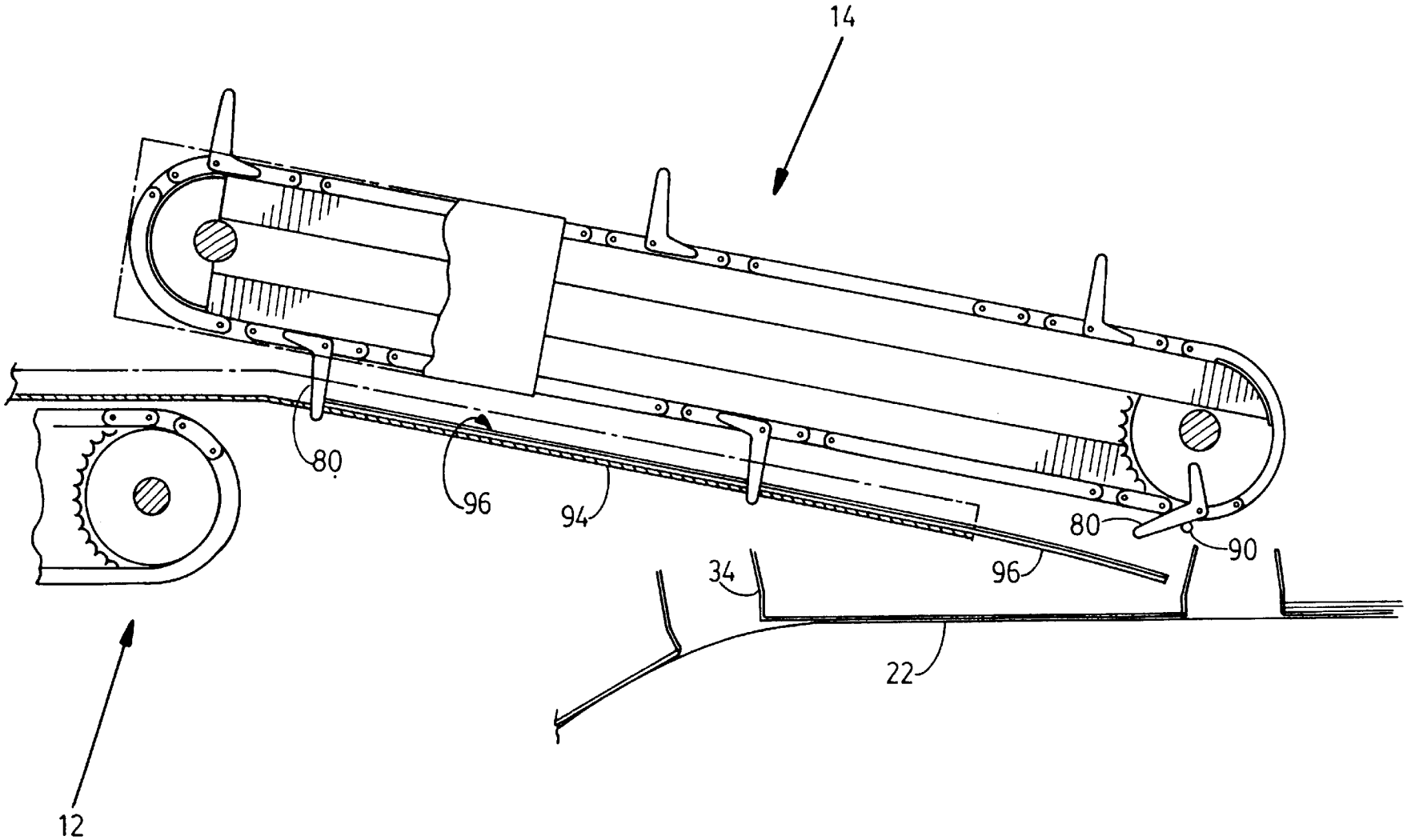
FIG. 13 is a cross-sectional view of the portion of the envelope stuffing machine of FIG. 12.
Figure 14:
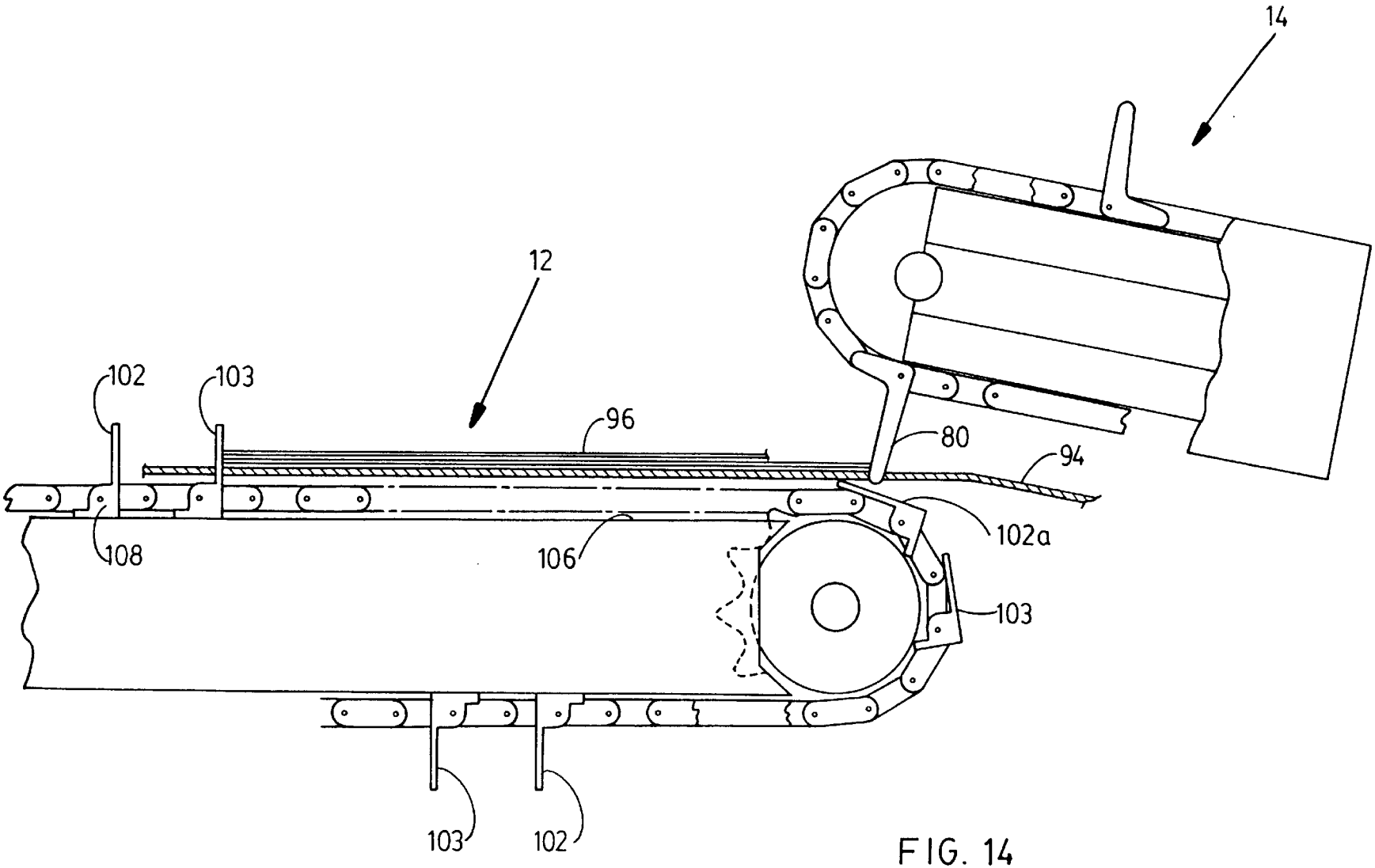
FIG. 14 is a cross-sectional view illustrating the portion of the envelope stuffing machine of FIG. 12 in another position.

Turning to FIGS. 12 through 14, the transfer conveyor 14 comprises L-shaped paper stack pushers 80 which are medially pivotably mounted to a circulating drive chain 84 at each side of the transfer conveyor. The inner legs 81 of the paper stack pushers slide on stationary abutment 86 when moving in the downstream direction 110 and along stationary abutment 88 when returning in the upstream direction. A cam pin 90 extends into the path of the paper stack pushers 80 at the downstream end of the transfer conveyor. A series of leaves 92 depend from the transfer conveyor and form, with underlying support platform 94, a path for guiding paper stacks 96. Sidewalls 98 extending from platform 94 further define the path for paper stacks. As will be apparent from the figures, the transfer conveyor declines toward its downstream end.

The paper stack conveyor 12 comprises sidewalls 100 extending from platform 94 and pairs of medially pivoted L-shaped flights 102, 103 (FIG. 14) driven by chain drives 104. During a portion of their downstream travel, the lower leg 108 of each flight rides along an abutment surface 106 which ends upstream of the downstream end of the paper stack conveyor. A downstream pair of flights 102 and the next adjacent upstream pair of flights 103 define an insert receiving zone 105. Flights 103 are detachable to permit an adjustment of the length of the insert receiving zone.

In operation, referencing FIGS. 12 to 14, in order to move paper stacks in a downstream direction 110, the chain drives of paper stack conveyor 12 are circulated in a clockwise direction and those of transfer conveyor 14 are circulated in a counterclockwise direction. As the flights 102, 103 move in a downstream direction, they are maintained in an upright position by abutment surface 106. Paper sheets are fed to support platform 94 of stack conveyor 12 in an insert receiving zone between pairs of longitudinally spaced flights 102, 103 to form paper stacks 96. The pair of flights 103 to the rear of a paper stack pushes the stack toward the transfer conveyor. As the pair of flights 102 at the front of a paper stack approaches the downstream end of the paper stack conveyor, they pass the end of abutment surface 106 and fall to an inoperative position illustrated by flight 102*a* of FIG. 14. This presents the front of the paper stack 96 to the transfer conveyor; the transfer conveyor is coordinated with the stack conveyor (electrically or mechanically) so that a pair of stack pushers 80 rotates into position in front of the stack just after the forward flights fall off abutment surface 106.

The longitudinal spacing of the flights 102, 103 is chosen to be greater than the length of the paper sheets which facilitates feeding of the sheets to the stack conveyor. However, as a result, it may be that, as illustrated in FIG. 14, the sheets of the stack are not all longitudinally registered when the stack is first formed on the stack conveyor. The stack conveyor is controlled (electrically or mechanically) to feed more quickly than the transfer conveyor. As a result, after a pair of stack pushers 80 rotates in front of a paper stack 96, the rearward flights 103 push the stack closer and closer to this pair of stack pushers. This has the effect of jogging any forwardly protruding sheets into registration with the other sheets of the stack to register the stack. The co-ordinated control may be set so that the spacing between the flights pushing the stack and the insert pushers in front of the stack is reduced to the length of sheets in the stack just as these flights 103 fall off abutment surface 106. Shortly thereafter, another stack pusher rotates in behind the stack and takes over the job of pushing same.

The transfer conveyor declines from the downstream end of the stack conveyor to the upstream end of the tray conveyor. Because the stack pushers 80 extend downwardly into the path of the insert stack, these pushers may operate in close proximity to the underlying tray conveyor. Platform 94 ends upstream of the downstream end of the transfer conveyor so that an insert stack may be pushed into a tray. As the pair of pushers 80 at the front of a stack of inserts approaches the tray conveyor, the pair passes the end of the abutments 86 which maintain the pushers in a protruding position. Cam pins 90 then cam these pushers out of the path of the trays 22. The cam pins are positioned so that when they cam the insert pushers, the cammed pushers do not contact the paper stack behind them.

Rest arm 70 is extends in a downstream direction from the downstream end of transfer conveyor 14 so that shortly after a stack falls onto a tray 22, the stack moves under the rest arm which then rests on the stack to assist in maintaining control of the stack.

Figure 6A:
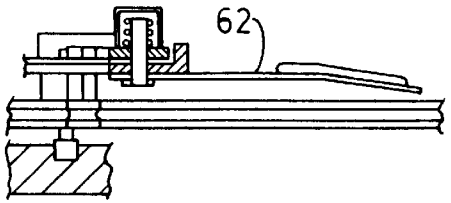
FIG. 6A is a partial cross-sectional view of a tray at position 1 of FIG. 1.
Figure 7:
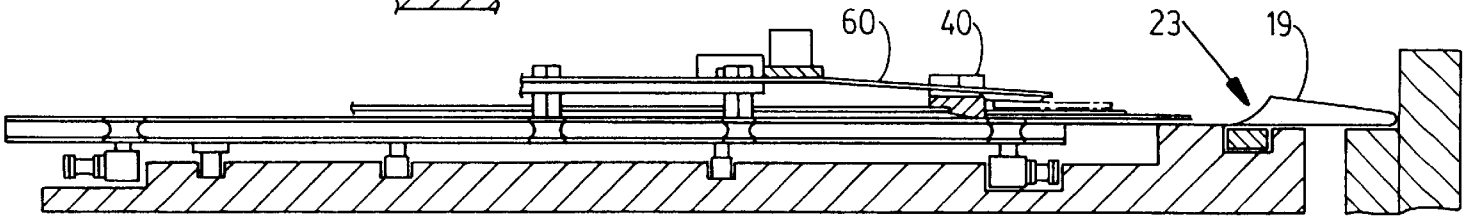
FIG. 7 is a cross-sectional view of a tray at position 3 of FIG. 1.
Figure 7A:
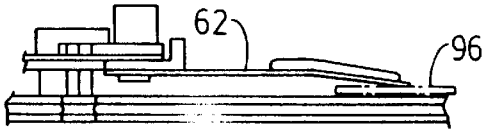
FIG. 7A is a partial cross-sectional view of a tray at position 3 of FIG. 1.

FIG. 1 illustrates nine positions of the tray conveyor 20 numbered 1 through 9. In position 1—which is illustrated in side view in FIGS. 6 and 6A—the rest arm is resting on an insert stack 96 on a tray 22 and the finger and flipper assembly 50 and reciprocating pusher 40 are cammed to their rearwardmost positions by cam tracks 59 and 48, respectively. In this rearwardmost position, assembly 50 and pusher 40 are spaced from the stack 96. At position 2, downstream of the rest arm, the cam tracks 48 and 59 begin moving the finger assembly 50 and the pusher 40 forwardly toward the envelope conveyor 18. The rate at which finger assembly 50 moves is greater than that of pusher 40 so that by position 3—which is illustrated in side view in FIGS. 7 and 7A—the finger assembly is partially over the stack 96 in order to maintain control of same. As well, between positions 2 and 3, cam track 30 begins to move tray 22 forwardly so that the tray overlaps the flap 21 of an envelope 19 at position 3. Referencing FIG. 11, between positions 3 and 4, the lower wall of the envelope 19 is drawn onto vacuum belt 116 by a vacuum applied via manifold 118 while puffer 122 blows air into the throat 23 of the envelope to open it. This facilitates insertion of fingers 60 and flippers 62 into the throat 23 of the envelope 19.

Figure 8:
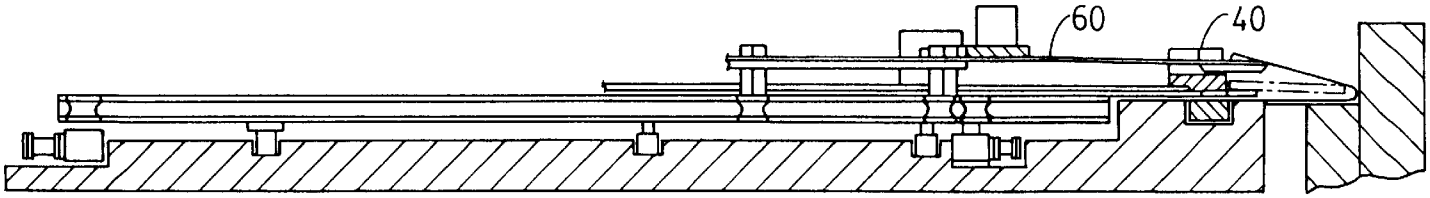
FIG. 8 is a cross-sectional view of a tray at position 6 of FIG. 1.
Figure 8A:
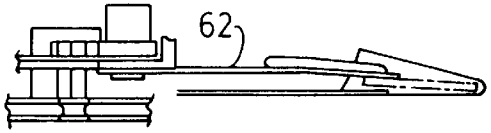
FIG. 8A is a partial cross-sectional view of a tray at position 6 of FIG. 1.
Figure 10:
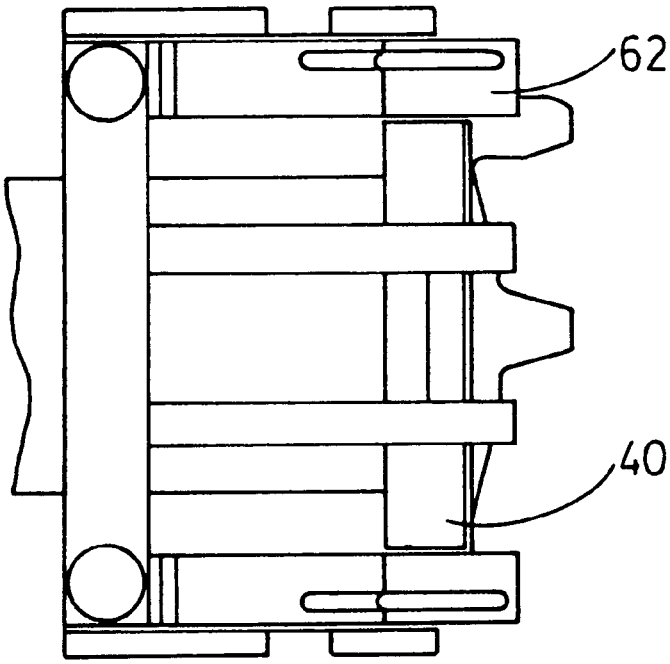
FIG. 10 is a plan view of a portion of a tray at position 6 of FIG. 1.

Between positions 4 and 6 of FIG. 1, cam track 48 moves pusher 40 forwardly which causes the pusher to push flippers 62 outwardly. This is illustrated in simplified plan view in FIGS. 9 and 10. As the flippers move outwardly, their convexly rounded surfaces 68 move into the side seams 25 of an envelope 19 in order to more fully open the envelope. The forward movement of the pusher also results in the pusher abutting the ramping cam surfaces 61 (FIG. 2) of the spring fingers 60. As the pusher continues to move forward, it moves along these surfaces causing the spring fingers to move upwardly thereby further opening envelope 19. The combined effect of the flippers and fingers is to fully open the envelope as the paper stack of inserts is inserted by the pusher 40 into the envelope. FIGS. 8 and 8A illustrate position 6 in side view.

An insert stack is moved fully into an envelope between positions 5 and 6. To facilitate this the envelope gripper is cammed to an open position between these stations and, turning to FIG. 11A, vacuum manifolds 120 and 124 apply vacuums to the top and underside of the envelope so that the envelope will not move transversely of downstream direction 110 as the insert stack is fully inserted. Once the insert stack is fully inserted, the envelope gripper may be released to grip the envelope and the inserted stack. Thereafter, the fingers 60 and flippers 62 and tray itself are withdrawn from the envelope.

A stack 96 lies on a tray 22 over runners 38 of the tray. The pusher 40 has downwardly directed notches receiving these runners. This assists in ensuring sheets of the inserts do not become jammed under the pusher as the pusher pushes the stack. Additionally, the pusher has a rearwardly tapering wedge-shaped cross-section. This cross-sectional shape also assists in ensuring sheets of the stack do not become jammed under the pusher.

It will be appreciated that the stack conveyor 12, transfer conveyor 14, tray conveyor 16, and envelope conveyor 18 move in downstream direction 110 in a continuous fashion so that paper stacks 96 are handled on-the-fly.

Modifications will be apparent to those skilled in the art and, accordingly, the invention is defined in the claims.

What is claimed is:

1. An on-the-fly paper stack conveyor, comprising:

a paper stack conveyor for continuously serially conveying stacks of paper;

a tray conveyor having an upstream end disposed downstream of a downstream end of said paper stack conveyor, said tray conveyor for continuously serially conveying a plurality of trays;

a transfer conveyor extending between said paper stack conveyor downstream end and said tray conveyor upstream end for conveying stacks of paper along a path from said paper stack conveyor into said trays, said transfer conveyor comprising paper stack pushers extending downwardly into said path;

said paper stack conveyor comprising flights for pushing stacks of paper, and including one or more drives for moving said flights more quickly than said paper stack pushers so that a given stack of paper advances to a paper stack pusher of a next downstream stack of paper just as a flight ceases pushing said given stack of paper whereby said given stack of paper is registered.

2. The paper stack conveyor of claim 1 including a stationary flight abutment for slidingly abutting said flights in order to maintain said flights in an extended operative position, said stationary flight abutment ending upstream of a downstream end of said insert conveyor, said flight ceasing to push said given stack when passing an end of said stationary flight abutment.

3. The paper stack conveyor of claim 2 wherein said path is defined by said transfer conveyor and a support extending therebelow which form a channel therebetween for the conveyance of stacks of paper.

4. The paper stack conveyor of claim 3 wherein each of said trays has a reciprocating pusher mounted for reciprocating movement on said tray and wherein said tray conveyor comprises a pusher cam track arranged for camming said reciprocating pusher to a retracted position at said upstream end of said tray conveyor thereby permitting a stack of paper to drop into a tray.

* * * * *